US005209148A

United States Patent [19]

MacDonald

[11] Patent Number: 5,209,148

[45] Date of Patent: May 11, 1993

[54] CARPETING CUTTER FOR USE IN SEAMING WALL-TO-WALL CARPETING AND METHOD FOR USING THE SAME

[75] Inventor: Lea MacDonald, Kingston, Canada

[73] Assignee: Orcon Corporation, Union City, Calif.

[21] Appl. No.: 919,927

[22] Filed: Jul. 27, 1992

[51] Int. Cl.[5] ..... B26B 27/00

[52] U.S. Cl. ..... 83/56; 30/287; 30/294; 30/314

[58] Field of Search ..... 83/13, 56, 620, 622; 30/294, 287, 289, 304, 279.2, 280, 299, 314, 317

[56] References Cited

U.S. PATENT DOCUMENTS

| | | | |
|---|---|---|---|
| 625,550 | 5/1899 | Geisendorff et al. | 30/294 |
| 2,601,414 | 6/1952 | Mittelstaedt | 30/294 |
| 3,363,314 | 1/1968 | O'Brien | 30/125 |
| 3,395,453 | 8/1968 | Prater | 30/294 X |
| 3,596,356 | 8/1971 | O'Neal | 30/280 X |
| 3,621,573 | 11/1971 | Summers | 30/287 |
| 3,772,793 | 11/1973 | Anderson et al. | 33/174 G |
| 3,859,725 | 1/1975 | Anderson et al. | 30/294 |
| 3,934,341 | 1/1976 | Carlson | 30/287 |
| 4,064,626 | 12/1977 | Meshulam et al. | 30/294 X |
| 4,064,627 | 12/1977 | Zanfini | 30/287 |
| 4,095,341 | 1/1978 | Crain | 30/287 |
| 4,646,439 | 3/1987 | Squires | 30/289 |
| 4,656,910 | 4/1987 | Peterson | 83/56 X |
| 4,833,956 | 5/1989 | Roberts | 83/56 |
| 5,159,758 | 11/1992 | MacDonald | 30/294 |

FOREIGN PATENT DOCUMENTS

| | | | |
|---|---|---|---|
| 821773 | 9/1969 | Canada . | |
| 907305 | 8/1972 | Canada | 30/65 |
| 1179112 | 12/1984 | Canada | 30/65 |

*Primary Examiner*—Frank T. Yost
*Assistant Examiner*—Clark F. Dexter
*Attorney, Agent, or Firm*—Haverstock, Medlen & Carroll

[57] ABSTRACT

An "S" shaped, double-blade carpet cutter is provided which simultaneously cuts the edges of two adjacent, overlapped carpets from the back side, to provide closely matching, abutting edges which can thereafter be seamed. The lower carpet edge is inserted into one opening of the "S", and the overlapping edge of the upper carpet is inserted into the other opening of the "S". One blade is mounted on the first or top arm of the "S" and the other blade is mounted on the second or middle arm of the "S", and the blades extend perpendicularly out of the plane of the "S" and are aligned to cut along a single seam line. A handle is attached to the third arm of the "S" to allow the cutter to be pulled along the overlapped carpet edges. Thus, when a first edge of carpeting is placed between the first and second arms, and an overlapping second edge of carpeting is placed between the second and third arms, and the cutter is rotated about the axis of the first arm so that the "S" is horizontal, the points of the blades will be driven up through the carpet backing from underneath; when the handle is pulled along the overlapping edges, both pieces of carpeting are cut along a seam line to produce closely matching, abutting edges which can be seamed when the short pieces cut off the edges by the cutter are removed.

25 Claims, 2 Drawing Sheets

CARPETING CUTTER FOR USE IN SEAMING WALL-TO-WALL CARPETING AND METHOD FOR USING THE SAME

BACKGROUND OF THE INVENTION

The present invention relates to carpeting cutters, and more particularly to carpeting cutters which simultaneously cut two different carpets for creating matched abutting edges for joining the two carpets in a seam using conventional seaming techniques.

It is often necessary, when carpeting a large area, such as a wide floor, with wall-to-wall carpeting, to seam together two or more widths of carpeting in order to cover the entire area. This is because carpeting is manufactured and sold in standard widths that are often smaller than the areas which are to be carpeted. Carpeting is often installed over a cushioning material, although it need not be. In a stretched carpet installation, once the cushion has been installed, the carpeting is rough fitted and trimmed, the seams between the carpet are created by cutting the adjoining carpet pieces to create clean edges for seaming and moving the two carpeting pieces as necessary to closely abut the clean edges, and joining the closely abutting edges of carpeting together using a hot-melt carpet seaming tape. The seamed carpet is then stretched to the periphery of the area to be carpeted, the carpet edges are trimmed and fastened to a tack strip or similar device installed along the periphery to provide a neat appearance. In a glue-down installation, the carpeting is rough fitted, and the seams between the carpet are created by cutting the edge of each adjoining piece of carpet to create clean, matched edges for seaming and moving the adjoining carpet pieces as necessary to closely abut the freshly cut edges, and joining the edges either with a carpet seaming tape or by directly gluing the edges to the cushion or the surface to be carpeted if no cushion is used. The rest of the carpet is also adhesively attached to the cushion or surface to be carpeted, and the edges are trimmed and secured to the periphery of the area and covered to provide a neat appearance, using a tack or tackless strip, cove base strip or similar product.

Because it is desirable to make the seams between the pieces of carpeting as invisible as possible, it is necessary that the edges of the carpeting to be joined be trimmed to provide a clean surface for seaming, and be closely matched to each other, to prevent any overlapping or gaps between the two pieces, which would produce visible defects at the seam. Thus, the edges to be abutted are often cut to match one another.

Heretofore, it has been difficult to easily obtain perfectly matching cuts between the two pieces of carpeting to be abutted and seamed. Simply laying a straight edge along the top of the carpeting and cutting downward with a blade through the carpeting pile and backing has produced unsatisfactory results. When carpeting is cut from above—that is, from the pile side—tufts of pile fibers will inevitably be snagged and cut as they are trapped between the backing and the blade. These missing fibers will make the seam visible. The effect is the same as if one took a small scissors and cut some of the pile along a line. It will be clearly visible.

One method for avoiding this difficulty is by using a guide rail for cutting in a relatively straight line from the top of carpeting through the backing between the pile fibers. For example, in U.S. Pat. No. 3,621,573 to Summers a guide rail rests on the top surface of the carpet backing between the pile fibers, and a blade aligned with the guide rail extends downward to cut through the carpeting as the guide rail moves over it. In Canadian patent 907,305, a rug cutting tool which has two parallel guides on either side of the tool body includes a blade disposed between the two plates for cutting down through the carpet. The guide rails of these two inventions are intended to prevent wavering of the knife and erratic cutting. However, care is required when a long cut made with these tools, and the cut made will still have appreciable error. Nor can these tools accurately cut overlapped carpets. An overlapping piece of carpet will force the carpet pile of the underlying pieces down, preventing a user cutting from above to avoid snagging and unevenly cutting the pile on the underlying piece of carpet.

U.S. Pat. No. 4,833,956 to Roberts discloses a cutter for simultaneously cutting overlapped pieces of carpets from one side of the carpet to the other. The Roberts cutter includes two large stacked slots that extend horizontally from the cutter body, so that each slot is bounded above and below by horizontal surfaces open at the front and along the sides. One slot runs parallel to and directly above the bottom plane surface of the body, and the other slot is directly above the first one (and similar in shape), and a blade runs vertically through the middle of both slots at the rear of the body. Thus, when one carpet edge is lifted and inserted into the lower slot and an overlapping carpet edge is inserted into the upper slot, and the cutter body is pushed forward, the carpet edges are directed against the knife edges within, producing a generally aligned cut through the backing and pile of both pieces. However, since the Roberts cutter lifts the carpet edges up off the floor, the cut edges will tend to overlap slightly and may not abut when the cut carpet is lowered onto the floor, and the resulting seam may tend to buckle unless the carpets are pulled apart after cutting. Difficulties can also be expected because, after cutting, the stiff carpeting must part enough to pass around the body at the rear of the Roberts cutter. As the freshly cut edges leave the knife and encounter the body, they must deflect to either side of the body. This deflection can increase the difficulty of use, will also tend to throw off the cut, and fatigue the user, causing error.

All of these tools are disadvantageous because, even if the tools can be used to make two separate cuts simultaneously, the carpeting must still be manipulated thereafter to make the two pieces, and such movement of the carpeting will affect the registration of any simultaneously produced cuts, making a perfect match difficult. Also, because the cuts are being made from the top or edge of the carpet, carpet pile fibers will be snagged or cut. Even where guide rails are used, because the location and arrangement of the carpet pile fibers varies from one manufacturer to another, it may be difficult to avoid cutting carpet pile fibers, and thus gaps or overlapping areas may be produced which will be evident when two abutting edges are joined.

Another solution, is to cut the carpeting from the backing side. This is clearly a better way to produce the edges to be mated because if the backing alone is cut, the pile fibers will not be snagged and cut. However, when an operator turns the edge to be cut, and pins it (using his body weight) between the surface to be carpeted and a straight edge, he compresses the pile. Because operators cannot control the depth of their cut with any precision, they often snag and cut the compressed and skewed underlying pile, again creating an unsightly, visible area after seaming.

As shown in my U.S. patent application, Ser. No. 07/767,325 filed Sep. 30, 1991, now U.S. Pat. No. 5,159,758, the carpet backing of two abutting pieces of carpeting can be cut simultaneously from the back side while the carpeting is in its normal position with the carpet pile facing up. While the use of this tool avoids completely the problem of cutting and snagging carpet fibers, as occurs when carpet is cut from above or from the edge, a gap between the two pieces of carpeting is produced which must be closed by moving the carpets to abut the edges. As noted above, this subsequent movement of the carpeting may throw off the registration of the cut edges, and the edges may, thereafter, not be perfectly aligned for seaming.

Accordingly, the need exists for an apparatus for cutting two carpet edges to produce nearly perfectly abutting edges, without further movement of the carpeting, and without cutting, snagging or otherwise removing carpet pile fibers along the edge to be joined, so as to produce a nearly invisible seam after the two abutting edges are joined using conventional methods.

SUMMARY OF THE INVENTION

The present invention provides a simple, inexpensive carpeting cutter which easily and quickly cuts overlapped carpets from the back side to produce nearly perfectly abutting edges which can thereafter be seamed using conventional methods. In one embodiment, the invention comprises a generally "S" shaped structure having three substantially parallel arms and two cross members, with blades on the first and second arms substantially aligned to produce cuts along substantially the same line, and a handle attached to the third arm for pulling the cutter along the top of the carpeting at the location of the seam. The two opposed openings of the "S" each accept one of the overlapping edges. When the cutter is laid flat, so that the plane formed by the three parallel arms is substantially horizontal, then the lower carpet runs over the first arm and under the second arm, while the overlapping upper carpet runs over the second arm and under the third, to which a handle is attached, and the upwardly extending, the second arm forcing the underlying carpet and the third arm forcing the overlying carpet onto the aligned knives positioned on the first and second arms which penetrate and cut the carpet backing from the bottom or back side. Thus, when the user draws the cutter by its handle along the overlapped carpeting, the blades will make two substantially coincident cuts. Because the cuts are made from the bottom of the backing up, carpet pile fibers will not be snagged or cut. Because the edges are in nearly perfect abutment after the cut is made, there is no need to worry about whether the cut is straight, and no requirement to provide any alignment aid. This provides the installer with greater flexibility, since abutting cuts can be made which are angled, circular, or scalloped, and will thereafter produce nearly invisible seams. Thus, a cutter of the invention can be particularly useful not just in installing new wall-to-wall carpet, but also in repairing existing wall-to-wall carpets by removing small areas which have been burned or stained and replacing them with a patch cut to near perfect alignment with the existing carpeting using a tool of the present invention.

In another embodiment, this invention provides a method of cutting overlapping carpet edges to produce perfectly aligned, abutting carpet edges which may thereafter be seamed.

Other and further embodiments and modifications will become apparent upon a consideration of the detailed description in conjunction with the drawings.

DETAILED DESCRIPTION OF THE INVENTION

Figure 2:
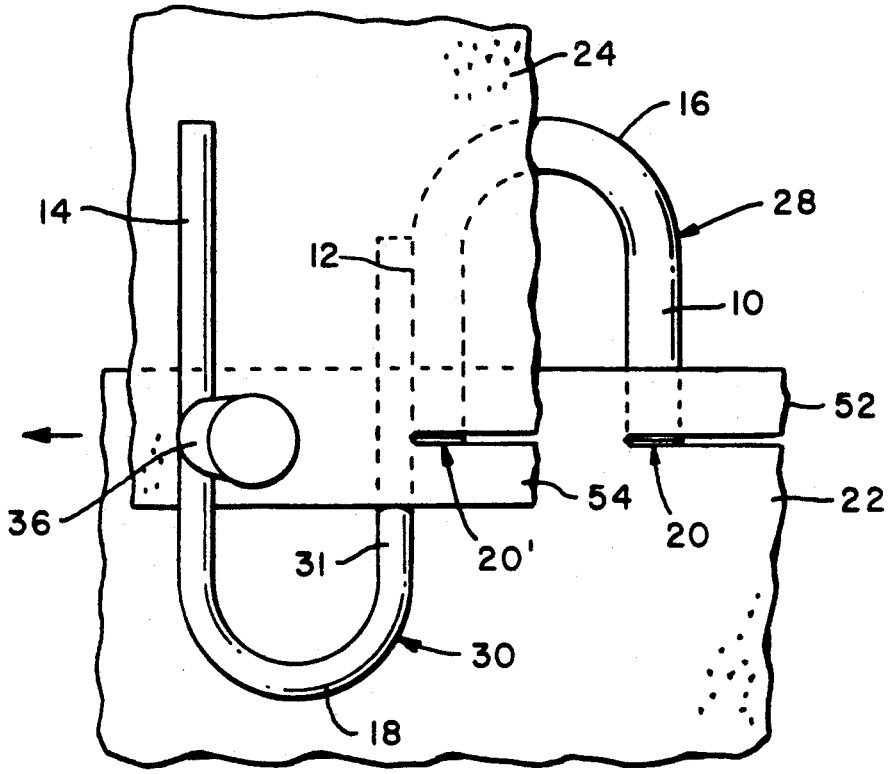
FIG. 2 is a partially cut-away, perspective top view of a cutter of the present invention.
Figure 1:
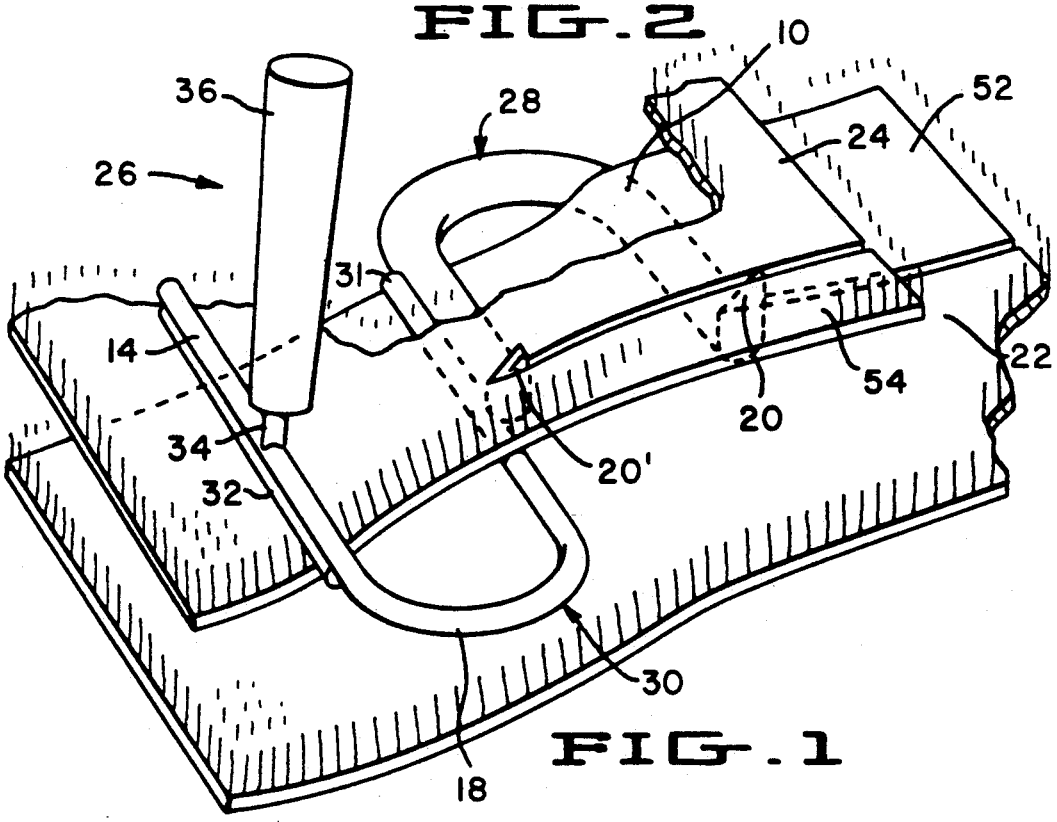
FIG. 1 is a top view of a carpet cutter of the present invention.
Figure 3:
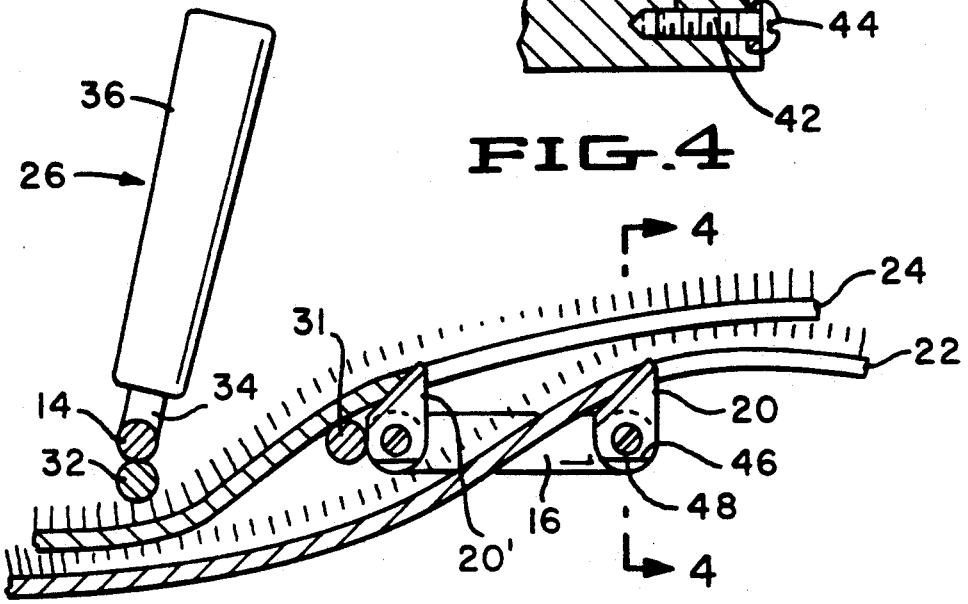
FIG. 3 is a cross-sectional side view of a cutter of the present invention taken through line 3—3 of FIG. 2.

As shown in FIGS. 1-3, the preferred overall shape of the cutter is a general "S" shape. The "S" may be divided into three generally parallel arms, first arm 10, second arm 12, and third arm 14, and two cross members, a first cross member 16, which joins first arm 10 to second arm 12 at one end, and a second cross member 18, which joins second arm 12 to third arm 14 at an opposite end to form a generally planar "S" shaped structure. Blade 20 is attached to the first arm 10 and blade 20' is attached to the second arm 12 so that the point of each blade extends upwardly when the planar "S" shaped body is substantially horizontal and so that the sharp edges of the blades 20, 20' are aligned in substantially the same plane, or are only slightly offset, so as to produce abutting carpet edges when they are used to cut or trim overlapping carpet edges 22, 24. The first arm 10, second arm 12, and third arm 14 are preferably aligned so as to be substantially parallel and so that the "S" which is formed by them falls in a single plane. Alternatively, the "S" shape can constructed so that the various components lie in different, parallel and closely spaced planes. For example, first arm 10, second arm 12, and first cross member 16 can be constructed to fall within a single arm plane, with second cross member 18 and third arm 14 extending out of the arm plane. It is also possible to construct a cutter of the present invention in which the first cross member 16 and the second cross member 18 are slightly offset to compensate for the thickness of the underlying carpeting 22 inserted between the first arm 10 and the second arm 12, and to compensate for the thickness of the overlapping carpeting 24 that is inserted between the second arm 12 and the third arm 14.

A handle 26 can be attached to, or formed integrally with, the third arm 14 for manipulating the cutter. Handle 26 can be offset from the "S" shaped cutter body, as shown in FIG. 1, to space it away from the top of the carpeting 24 and the point of the blades 20, 20' when the "S" structure is in use as shown in FIG. 1, for enabling the operator to safely grasp and pull the cutter to produce cut edges for seaming. Handle 26 is preferably furnished with a vertically oriented grip 36, as shown in the drawings, and is angled slightly forward towards the cutting blades, to provide an ergonomically comfortable handle for an operator who typically grips the device from above.

In the best mode, the "S" shape is preferably produced by joining together two opposed, generally "C" shaped members 28, 30. Members 28, 30 are preferably formed from steel stock such as round rod, and are preferably joined by welding. However, other suitable materials, such as other metals, wood, or plastic, can also be used and may be joined using any suitable material such as adhesives or mechanical fasteners like bolts, screws, rivets or crimped sleeves, or the entire structure may be integrally formed, using a variety of known techniques such as molding or die casting. In this embodiment, the first arm 10 is the upper arm of the first "C" 28 and the first cross member 16 is the bend between the upper arm and the lower arm of the first "C" 28. The second arm 12 is formed where the lower arm 29 of the first "C" 28 and the upper arm 31 of the reversed, second "C" 30 are joined together, preferably by welding. The second cross member 18 is formed by the bend between the upper arm 31 and the lower arm 14 of the second, reversed "C" 30.

An upwardly extending handle bar 34 is preferably provided which includes a handgrip 36. Elements 34 and 36 together constitute handle 26, which is used to manipulate the S-shaped cutter body as shown in FIGS. 1 and 2.

Figure 4:
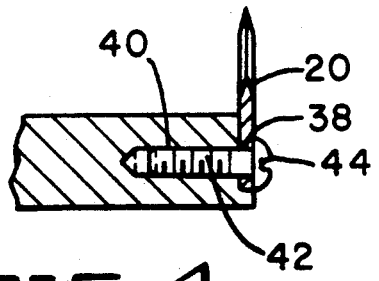
FIG. 4 is a cross-sectional detail showing a preferred method of removably attaching blades to a cutter of the present invention, taken through line 4—4 of FIG. 3; and, FIG. 5 is a side view if a cutter of the present invention.
Figure 5:
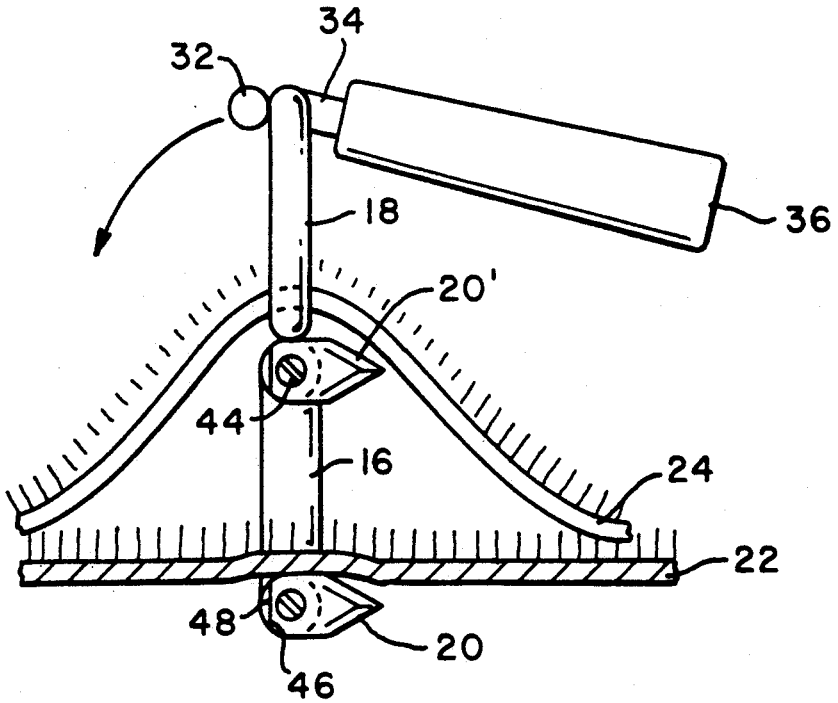

As shown in more detail in FIGS. 3–5, blades 20, 20' extend upwardly out of the plane of the "S". The blades 20, 20' are preferably attached to the ends of the upper arm 10 and lower arm 29 of the first "C" member 28 so that the points extend upwardly out of the arm plane. The blades 20, 20' are preferably planar and can be made easily replaceable to aid replacement when a blade becomes dull or broken, by providing a hole 38 near the bottom of each blade 20, 20', and by providing a threaded opening 40, 40' in the ends of the upper arm 10 and lower arm 29 respectively for receiving a threaded fastener 42, 42', such as a screw or a bolt. The ends 50, 50' of arms 10, 29 are preferably machined to provide a flat surface substantially perpendicular to the arm plane. The blades 20, 20' can then be secured to the arms 10, 29 by threading a threaded fastener 42, 42', such as a screw or a bolt, through the hole 38 in each blade 20, 20' and into the threaded opening 40, 40', and by rotating the threaded fastener 42, 42' about its longitudinal axis to tighten the fastener 42, 42' in the threaded opening 40, 40' so that the fastener head 44 bears against the surface of each blade 20, 20', holding it firmly against the substantially flat end 50, 50' of the arms 10, 29. To prevent rotation of the blades 20, 20' about the longitudinal axis of the threaded fastener 42, 42' when the blades 20, 20' are being drawn against the carpet backing, a flat 46 is preferably provided on the bottom of each blade 20, 20' which cooperates with a protruding flat 48 provided at the end of each arm 10, 29, and oriented to position each blade with the point up when the "S" shaped cutter body is substantially horizontal. Protruding flat 48 can be easily be formed when the ends 50, 50' are machined flat by selectively removing material from the upper portion of the end 50, 50' of each arm 10, 29. The ends 50, 50' are preferably substantially co-planar so that the mounted blades 20, 20' are aligned for making very closely abutting cuts, as described below.

Blades 20, 20' are preferably angled so that the cutting edge of the blades 20, 20' are not perpendicular to the plane of arms 10,12, but rather are angled slightly from vertical in the direction away from arm 14. This can be accomplished by attaching an extension member 32 to the bottom of third arm 14, which will cant the arm plane formed by arms 10, 12 so that the arm plane is slightly higher at the arm 12 end. Alternatively, protruding flat 48 can be oriented so that it is not parallel with the arm plane, but rather is canted to be higher on the end closest to handle 26 to angle the cutting edge of the blade 20, 20' away from handle 26. Thus, when the blades 20, 20' become so dull that they will not cut properly, the tool will not stop, become stuck, or mangle the carpet backing. Rather, the carpet backing will be deflected over the blades 20, 20' and the operator will be informed of the need to change the blades without forcing the tool and damaging the carpet backing.

The blades 20, 20' are preferably sized so that each blade 20, 20' cuts only the carpet backing in which it is in direct contact, and does not appreciably extend into the carpet pile. It should be noted that the blades are depicted in some of the figures as relatively longer than they should normally be, solely for the purpose of illustration, to aid in the identification of parts and their relative placement, and to explain the operation of a cutter of the present invention. Thus, blade 20 should preferably not be so long that it extends substantially into the carpet pile attached to the backing with which it is in direct contact, or so long that it cuts carpet 24 as well as carpet 22. Using a short blade which cuts only the backing provides a cleaner cut, and provides for operator safety. The blades 20, 20' are preferably single-edged for cutting in one direction, and should be oriented with the cutting edge facing the handle; alternatively, a double-edged blade 21, 21' shown in FIG. 5 can be used for bi-directional cutting.

A cutter of the present invention is used in the area of an overlap between two pieces of carpeting 22, 24 to produce closely matched, abutting edges which can thereafter be seamed. Two adjacent pieces of carpet 24, 22 are positioned on a surface to be carpeted with the carpet backing against surface and the carpet pile extending vertically upward from the backing. The two adjacent pieces of carpeting 22, 24 are overlapped along an edge where the operator desires to form a seam, so that carpet 24 overlaps carpet 22. As shown in FIG. 5, to begin, the operator preferably holds the cutter so that the plane of the "S" body is in a substantially vertical position. In this position, the operator can lift the edges of the carpet pieces 24, 22 at one end of the seam and place them in the cutter so that the lower carpet edge 22 rests on the first arm 10 and so that the upper carpet edge 24 rests on the second arm 12. When the cutter body is rotated about the longitudinal axis of first arm 10, moving the plane of the "S" shaped cutter body to a substantially horizontal position, the second arm 12 presses against the carpet pile of carpet 22, forcing the carpet 22 down onto blade 20, and the third arm 14 presses against carpet pile of carpet 24 forcing it down onto blade 20', and, at the same time, the points of blades 20, 20' are rotated into and penetrate the carpet backing from the back side. With third arm 14 resting against the top of the carpeting and the handle in an upwardly extending position, the operator can then draw the cutter, e.g., by pulling it, from one end of the seam to the other to quickly and cleanly cut the carpet backing from the bottom side without snagging the carpet fibers. The action of the second arm 12 and the third arm 14 in pressing the carpeting onto the blades 20, 20' is aided by the stiffness or rigidity of the carpet backing. The overlapping pieces 52, 54 trimmed from the edge of each piece of carpet 22, 24, can then be removed. The abutting carpet edges will be perfectly matched, or nearly so, and can be immediately seamed using conventional techniques without further movement of the carpet pieces relative to one another.

It will be seen that the invention is simple, sturdy, inexpensive, and easy to use tool, which in use enables the operator to cut perfectly matching abutting edges which are ready to seam. The easily replaced blades allow quick changes to avoid lost time when the blades break or become dull.

While the preferred embodiments have been described in detail, and shown in the accompanying drawings, one skilled in the art will recognize that various further modifications are possible without departing from the scope of the invention as set forth in the appended claims. Particular variations of the shape, various blades and/or blade mountings, different blade positions on the arms, particular handle arrangements, and like designs other than those of the preferred embodiment, are possible and feasible. For example, one could extend the second cross-member 18 away from the blade plane and attach a handle to it, thus eliminating the third arm 14, and providing other means, as necessary, to force the top of the carpeting down against the underlying, upwardly extending blades. In addition, other materials, such as plastics, wood, or matrix materials, may be used in addition to, or instead of, metal. Various designs adapted to such molded or formed materials will be apparent to those in the art. Further one skilled in the art will recognize that a mirror-reflection embodiment of the embodiment shown in the drawings can be constructed and used, and other such changes can be effected without departing from the scope of the claims.

I claim:

1. A carpeting cutter for simultaneously cutting a first and a second piece of carpeting to produce substantially matched, closely abutting edges, the first and second piece of carpeting each having a pile side and a backing side, and overlapped along one edge, said cutter comprising:

a generally "S" shaped cutter body having a first arm including a first end, a second end, and a longitudinal axis passing through said first and second end, a second arm having a first end and a second end, a first cross member extending between the first end of the first arm and the first end of the second arm, a third arm having a first end and a second end, a second cross member extending between the second end of the second arm and the second end of the third arm, said first arm and second arm lying substantially in a single arm plane, a first blade attached to the first arm, and extending out of said arm plane, said first blade having a point, a base and a sharp cutting edge extending between the point and the base, said blade aligned so that the point of the blade will penetrate the backing side of the first piece of carpeting and the cutting edge of the blade will cut the backing of the first carpet to produce a first cut edge, a second blade attached to the second arm, and extending out of said arm plane, said second blade having a point, a base and a sharp cutting edge extending between the point and the base, said second blade aligned so that the point will penetrate the backing side of the second piece of carpeting and so that the sharp edge will cut the overlapping backing of the second piece of carpeting to produce a second cut edge which matches and substantially abuts the first cut edge; and, a means for moving the cutter body along the overlapping edges of the first and second pieces of carpeting.

2. The carpet cutter of claim 1 in which said first and second blade cutting edges are aligned relative to each other along a blade plane.

3. The carpet cutter of claim 1 including a means for aligning the blades and maintaining the alignment during use.

4. The carpet cutter of claim 1 in which the means for moving the cutter body is a handle attached to the third arm.

5. The carpet cutter of claim 1 in which the cutter body is "S" shaped.

6. The carpet cutter of claim 1 in which the generally "S" shaped cutter body is formed from two generally "C" shaped members, the first "C" shaped member including a first arm portion corresponding to the first arm and a second arm portion each extending away from a curved back to an end, and an opening between the ends of the first and second arm portion the second "C" shaped member including a first arm portion corresponding to the third arm and a second arm portion each extending away from a curved back to an end, and an opening between the ends of the first and second arm portion the two "C" shaped members joined along their second arm portion after inverting one of the "C" members so that the opening of the first "C" shaped member faces an opposite direction from the opening of the second "C" shaped member.

7. The carpet cutter of claim 6 in which the first blade is attached to the first arm and the second blade is attached to the second arm portion of the first "C" shaped member.

8. The carpet cutter of claim 7 including a means for maintaining alignment of the blades which includes a protruding flat surface along the bottom of each end of each arm of the first "C" which cooperates with a flat edge along the base of each blade.

9. The carpet cutter of claim 8 further including a means attached to the third arm for elevating the third arm and canting the arm plane.

10. A carpet cutter for simultaneously cutting along the underside of overlapping edges of two pieces of carpet to produce substantially matching, closely abutting edges which can be seamed, the carpet cutter comprising:

an elongated first arm;

an elongated second arm substantially parallel to the first arm;

the first arm and the second arm together defining an arm plane;

a generally planar first blade having a first cutting edge and mounted on the first arm;

a generally planar second blade having a second cutting edge and mounted on the second arm;

the first blade and the second blade aligned and defining a blade plane substantially perpendicular to the first arm, the second arm, and the arm plane;

a third arm lying parallel with and close to the arm plane;

the first arm, second arm, and third arm forming an array having a front edge corresponding to the first arm, a back edge corresponding to the third arm, a first edge and a second edge, whereby a first carpet edge may be inserted between the first arm and the second arm, and a second, overlapping carpet edge may be inserted between the second arm and the third arm;

a first cross member joining the first arm to the second arm at the first edge of the array, and a second cross member joining the second arm to the third arm at the second edge of the array to form the general "S" shape; and a handle attached to the third arm for the user to manipulate the cutter.

11. The cutter according to claim 10, wherein the first blade and the second blade are double edged to cut in two opposing directions.

12. The cutter according to claim 10, wherein the handle includes a handle grip offset away from the arm plane by a handle bar.

13. The cutter according to claim 10 including a means for maintaining alignment of the blades during use.

14. The cutter according to claim 13 in which the means for maintaining alignment of the blades includes a protruding flat surface on the first and second arm which cooperates with a flat edge along the base of each blade.

15. The carpet cutter of claim 14 in which the means for maintaining alignment of the blades additionally includes a means for elevating the back of the array when the array is placed on a substantially horizontal surface.

16. A carpet cutter body for mounting and aligning two blades for simultaneously cutting the backing of overlapping edges of two adjacent pieces of carpet from the bottom up to produce substantially matching, closely abutting edges which can be seamed, the carpet cutter body comprising:

an elongated first arm;

an elongated second arm substantially parallel to the first arm;

the first arm and the second arm together defining an arm plane;

a means for mounting a first blade on the first arm;

a means for mounting a second blade on the second arm;

a means for maintaining alignment of the mounting means for the first and second blades to hold the blades to define a blade plane substantially perpendicular to the first arm, the second arm, and the arm plane, and for holding the cutting edge of each blade in a preselected position;

a third arm lying parallel with and close to the arm plane;

the first arm, second arm, and third arm forming an array having a front edge corresponding to the first arm, a rear edge corresponding to the third arm, a first edge and a second edge, an opening between the first and second arms and another opening between the second and third arms whereby a first carpet edge may be inserted between the first arm and the second arm, and a second, overlapping carpet edge may be inserted between the second arm and the third arm;

a first cross member joining the first arm to the second arm at the first edge of the array, and a second cross member joining the second arm to the third arm at the second edge of the array to form a generally "S" shaped cutter body; and a means for manipulating the cutter body.

17. The cutter body of claim 16 in which the means for manipulating the cutter body is a handle attached to the third arm.

18. The cutter according to claim 16 in which the means for maintaining alignment of the mounting means for the blades includes a protruding flat surface on the first and second arm to cooperate with a flat edge on the first and second blade.

19. The carpet cutter of claim 16 in which the means for maintaining alignment of the mounting means for the blades includes a means for elevating the back edge of the array when the array is placed on a substantially horizontal surface.

20. A carpet cutter for simultaneously cutting two adjacent pieces of carpet which are overlapped along one edge, the two pieces of carpeting each having a backing portion underlying a pile portion, such that each piece of carpeting is cut from the underside up through its backing portion, to produce substantially matching, closely abutting edges which can be seamed, the carpet cutter comprising:

an elongated first arm;

an elongated second arm substantially parallel to the first arm;

the first arm and the second arm together defining an arm plane having a first end, a second end, and a back end corresponding to the second arm;

a first cross member extending between the first arm and the second arm at the first end of the arm plane;

a second cross member extending away from the second arm at the second end of the arm plane;

a generally planar first blade having a base, a point and a cutting edge and mounted on the first arm;

a generally planar second blade having a base, a point and a cutting edge and mounted on the second arm;

a means for maintaining alignment of the first blade and the second blade to define a blade plane substantially perpendicular to the first arm, the second arm, and the arm plane; and, a means located adjacent to the back end of the arm plane for exerting a force generally perpendicular to the arm plane in a direction opposing the points of the blades;

a means for moving the cutter along the overlapping carpet edges, said moving means located above the pile portion of the carpet pieces.

21. The carpet cutter of claim 20 in which the means for exerting a force is a third arm lying substantially parallel with the arm plane and joined to the second arm by the second cross member.

22. The carpet cutter of claim 21 in which the means for moving the cutter is a handle attached to the third arm.

23. The carpet cutter of claim 20 in which the means for maintaining alignment of the blades includes a protruding flat surface on the first and second arm which cooperates with a flat edge along the base of each blade.

24. The carpet cutter of claim 20 in which the means for maintaining alignment of the blades includes a means for elevating the back of the arm plane when the arm plane is placed on a substantially horizontal surface.

25. A method for simultaneously cutting two adjacent pieces of carpeting which overlap along one edge to produce closely matching abutting edges between the two carpet pieces, the carpeting having a backing portion and a pile portion and oriented with the backing portion lying against a surface to be carpeted and with the pile portion extending away from the surface to be carpeted, using a carpeting cutter having an elongated first arm, an elongated second arm substantially parallel to the first arm, the first arm and the second arm together defining an arm plane having a first end, a second end, and a back end corresponding to the second arm, a first cross member joining the first arm to the second arm at the first end of the arm plane to form a first opening to receive a first piece of carpeting at the second end of the arm plane, a second cross member extending away from the second arm at the second end of the arm plane to form a second opening to receive an overlapping piece of carpeting at the first end of the arm plane, a means for exerting a force against the pile portion of the second piece of carpeting adjacent to the back end of the arm plane, a first blade having a point and a cutting edge mounted on the first arm, a second blade having a point and a cutting edge mounted on the second arm, the first and second blades being aligned in a blade plane substantially perpendicular to the first arm, the second arm, and the arm plane, and a means for moving the cutter, the method comprising the steps of:

placing the edge of the underlying piece of carpeting into the first opening so that the backing portion of the first piece of carpeting lies over the first arm;

placing the edge of the overlapping piece of carpeting into the second opening so that the backing portion of the second piece of carpeting lies over the second arm;

placing the arm plane in a substantially horizontal position so that the second arm pushes against the pile portion of the first piece of carpeting and the means for exerting a force pushes against the pile portion of the second piece of carpeting, such that the point of the first blade is inserted into the backing portion of the first piece of carpeting, causing the cutting edge of the first blade to engage the backing portion of the first piece of carpeting, and such that, at substantially the same time, the point of the second blade is inserted into the backing portion of the second piece of carpeting, causing the cutting edge of the second blade to engage the backing portion of the second piece of carpeting;

moving the cutter in a direction substantially perpendicular to the first and second arms and along the overlapped edges of the carpeting to cut the backing portion of the carpeting along a single seam line; and, removing the pieces cut from the edges of the carpeting by the cutter.

* * * * *